US010269508B2

(12) United States Patent
Simon et al.

(10) Patent No.: US 10,269,508 B2
(45) Date of Patent: Apr. 23, 2019

(54) LOW VOLTAGE ELECTRICAL CONTACT SYSTEM WITH ENHANCED ARC BLOW EFFECT

(71) Applicant: ABB Schweiz AG, Baden (CH)

(72) Inventors: Reinhard Simon, Dättwil (CH); Erik Johansson, Västerås (SE); Göran Eriksson, Västerås (SE); Moritz Boehm, Fislisbach (CH); Gunnar Johansson, Västerås (SE)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 15/924,728

(22) Filed: Mar. 19, 2018

(65) Prior Publication Data

US 2018/0277315 A1 Sep. 27, 2018

Related U.S. Application Data

(63) Continuation of application No. PCT/EP2016/071993, filed on Sep. 16, 2016.

(30) Foreign Application Priority Data

Sep. 18, 2015 (EP) ..... 15185869

(51) Int. Cl.
*H01H 1/06* (2006.01)
*H01H 9/30* (2006.01)
(Continued)

(52) U.S. Cl.
CPC ..... *H01H 1/06* (2013.01); *H01H 1/50* (2013.01); *H01H 9/30* (2013.01); *H01H 9/38* (2013.01); *H01H 9/40* (2013.01); *H01H 11/04* (2013.01)

(58) Field of Classification Search
CPC .. H01H 1/06; H01H 9/40; H01H 9/38; H01H 1/50; H01H 11/04
See application file for complete search history.

(56) References Cited

U.S. PATENT DOCUMENTS 3,089,936 A * 5/1963 Smith, Jr. ..... H01H 33/6642 200/279
3,836,740 A * 9/1974 Hundstad ..... H01H 33/6642 200/288

(Continued)

FOREIGN PATENT DOCUMENTS

CH 420330 A 9/1966
DE 3411784 A 1/1985

(Continued)

OTHER PUBLICATIONS

European Patent Office, International Search Report & Written Opinion issued in corresponding Application No. PCT/EP2016/071993, dated Oct. 13, 2016, 10 pp.

(Continued)

*Primary Examiner* — Truc T Nguyen
(74) *Attorney, Agent, or Firm* — J. Bruce Schelkopf; Taft Stettinius & Hollister LLP

(57) ABSTRACT

Electrical contact system with a first and a second contact (1, 5), each having a contact surface (4, 8). The first electric contact (1) has a mesostructured electric contact portion (14) with a plurality of slots (15) and ridges (16) formed between neighboring slots (16) of the plurality of slots (16). These slots (15) and ridges (16) extend in a direction running transversely to said switching plane (X-Z) form a plurality of current paths (16). The current paths (16) are inclined to the first contact surface (4) at a first angle (17) measuring less than 60 degrees such that an interruption current (12) flowing through the mesostructured electric contact portion (14) and through an electric arc (11) extending in between (Continued)

the first contact surface (4) after lifting the first contact surface (4) off the second contact surface (8) pushes said electric arc (11) in the direction of the apex of said first angle (17) from a first position (18) to a second position (19).

23 Claims, 4 Drawing Sheets

(51) Int. Cl.

| | |
|---|---|
| ***H01H 9/38*** | (2006.01) |
| ***H01H 9/40*** | (2006.01) |
| ***H01H 1/50*** | (2006.01) |
| ***H01H 11/04*** | (2006.01) |

(56) References Cited

U.S. PATENT DOCUMENTS 4,375,021 A * 2/1983 Pardini ..... H01H 9/36 218/25
4,390,762 A * 6/1983 Watzke ..... H01H 33/6642 200/275
4,393,287 A * 7/1983 Nakano ..... H01H 9/342 218/148
4,453,053 A * 6/1984 Yamagata ..... H01H 9/38 218/148
4,553,002 A * 11/1985 Slade ..... H01H 33/664 218/128
4,611,106 A * 9/1986 Pardini ..... H01H 1/50 218/30
4,675,482 A * 6/1987 Bialkowski ..... H01H 33/6644 218/129
4,963,849 A * 10/1990 Kowalczyk ..... H01H 9/342 218/35
6,177,643 B1 * 1/2001 Marin ..... H01H 33/245 218/154
6,388,215 B1 * 5/2002 Sepelak ..... H01H 1/42 200/254
2009/0057273 A1 * 3/2009 Kil ..... H01H 9/36 218/149
2009/0223934 A1 * 9/2009 Tetik ..... H01H 9/362 218/151
2012/0091102 A1 * 4/2012 Kim ..... H01H 33/6643 218/128
2012/0181254 A1 * 7/2012 Kantas ..... H01H 33/6645 218/22
2015/0028973 A1 * 1/2015 Cardwell ..... H01H 77/108 335/6
2015/0248978 A1 * 9/2015 Gentsch ..... H01H 33/6642 218/128
2016/0064169 A1 * 3/2016 Ashtekar ..... H01H 1/02 218/18

FOREIGN PATENT DOCUMENTS

EP 2261940 A1 12/2010
JP 2012084368 A 4/2012

OTHER PUBLICATIONS

European Patent Office, Extended Search Report issued in corresponding Application No. 15185869.3, dated Mar. 21, 2016, 5 pp.
ABB Schweiz AG, PCT Direct Letter submitted to European Patent Office on Sep. 16, 2016 in corresponding Application No. PCT/EP2016/071993, 2 pp.

* cited by examiner

LOW VOLTAGE ELECTRICAL CONTACT SYSTEM WITH ENHANCED ARC BLOW EFFECT

TECHNICAL FIELD

The invention belongs to the field of low or medium voltage circuit switchgear such as motor circuit breakers or motor starters/contactors, for example.

BACKGROUND ART

In most low voltage circuit breakers, a contact pair of a stationary and a movable electrical contact are touching one another in a closed state of the circuit breaker. If the electric path through the circuit breaker shall be interrupted, the movable electric contact is moved along a path of movement relative to the stationary contact such that an electric arc is formed in between the stationary and a movable electrical contact. The foot points of the electric are spot-like and rather stationary in an initial phase of the interruption process. For extinguishing the electric arc, several methods can be employed. Most of them have in common that the electric arc is driven along a set of conductor rails electrically connected with the stationary and a movable electrical contact towards a set of splitter plates where the electric arc is interrupted eventually.

A first approach resides in that the electric arc is driven towards the splitter plates by way of a stream of pressurized air.

A second approach resides in exposing the electric arc to a magnetic field, e.g. from a permanent magnet. Said magnet is employed for urging the electric arc away from the stationary and a movable electrical contact towards the set of splitter plates.

A third approach resides in designing the nominal conductor path as well as the at the stationary and the movable electrical contact such that the natural magnetic field of the current flowing through the conductor path exerts its power on the electric arc such that the electric arc is urged away from the stationary and a movable electrical contact towards the set of splitter plates. A close-up of the interruption portion of a representative of the third approach is shown in FIG. 1. That electrical contact system illustrated in FIG. 1 comprises a first electric contact 1 shown as an upper contact as well as a second electric contact 3 shown as a lower contact in an open state of the electrical contact system. The first electric contact 1 has a first contact carrier 2 that is electrically conductively connected with a first contact piece 3 having a first contact surface 4. Likewise, the second electric contact 5 has a second contact carrier 6 that is electrically conductively connected with a second contact piece 7 having a second contact surface 8. The first electric contact 1 and the second electric contact 5 are movable relative to one another along a switching path extending in a switching plane X-Z. The switching path can be linear or arcuate.

The first contact surface 4 and the second contact surface 8 touch each other in a closed state of the electrical contact system. The first contact surface 4 is displaced by an insulating distance 9 to the second contact surface 8 in an open state of the electrical contact system such that the desired interruption and safe electric insulation between the first and second contact is achieved. The first contact surface 4 and the second contact surface 8 extend transversely, i.e. perpendicularly to said switching plane X-Z in the direction of virtual plane X-Z. Once this electrical contact system is opened, an electric arc 11 evolves between the first contact surface 4 and the second contact surface 8. Since the current path of the nominal as well as of the interruption current path lead through the first electric contact 1 and the second electric contact 5 in a loop when seen in plane X-Z, the natural magnetic field of the interruption current 12 pushes the electric arc 11 from the left to the right. In other words, the natural magnetic field of the interruption current 12 exerts a pressure or force 13 on the electric arc 11.

The third approach may suffer the problem that the natural magnetic field of the current flowing through the conductor path exerts only little power on the electric path such that it may remain in between the stationary and the movable electrical contact for too long before moving towards the set of splitter plates, provided that the electric arc moves towards the latter at all.

GENERAL DISCLOSURE OF THE INVENTION

The object to be solved by the present invention resides in moving the electric arc in the third approach faster and more reliable away from the contact tips of the electric contacts for arc extinction.

That object is solved by a specific geometry of the contact tips of the electric contacts guiding the electric arc such that it is forced to flow in an acute angle relative to the contact surface of the contact tips such that the of the electric contacts. As a result, a much higher magnetic driving force acting on the arc is achieved upon opening of the electric contacts, A faster movement of the electric arc off the actual electric contacts is advantageous as the arc-contact interaction time can be reduced. The shorter the arc-contact interaction time the smaller the contact erosion.

Hereinafter the term 'low voltage' is understood as less than a 1000 Volt whereas the term 'medium voltage' is understood as more than a 1000 V but less than about 72 kV.

In a most basic embodiment, the electrical contact system comprises a first electric contact with a first contact surface and a second electric contact with a second contact surface. The first electric contact and the second electric contact are movable relative to one another along a switching path extending in a switching plane such that the first contact surface and the second contact surface touch each other in a closed state of the electrical contact system. That term is to be understand as comprising embodiments of electrical contact systems where only the first electric contact is movable relative to the stationary second electric contact, but also embodiments where only the second electric contact is movable relative to the first stationary electric contact, but also embodiments where both the first electric contact as well as the second electric contact are movable relative to one another.

The first contact surface is displaced by an insulating distance to the second contact surface in an open state of the electrical contact system. The first contact surface the second contact surface extend transversely to said switching plane. At least one of the first electric contact and the second electric contact comprises a mesostructured electric contact portion with a plurality of slots and ridges formed between neighboring slots of the plurality of slots. The plurality of slots and ridges extend in a direction running transversely to said switching plane form a plurality of current paths leading through the mesostructured electric contact portion.

Depending on the embodiment, the term slots shall not be limited to a slot that is open at the contact surface but shall also encompass embodiments where the slots end somewhere below the contact surface such that they are delimited by electrically conductive material when seen in the switching plane (X-Z). In other words, the slots do not need to discharge into their dedicated contact surface but can have a closed cross-section when seen in the switching plane (X-Z).

Moreover, the term ridges shall not be limited to a ridge having the shape of a pin or a finger that is extending to the contact surface, but also to ridges that end somewhere below the contact surface when seen in the switching plane (X-Z).

The term 'mesostructured electric contact portion' is understood as a porous compound material comprising a plurality of electrically conducting portions like the ridges with dimensions between 50 micrometers and 2 millimeters which are employed to form the current paths and a plurality of slots forming barriers for the current flow as they prevent the nominal current as well as the interruption current from flowing freely through specific regions of the electrical contact system. The sub-term 'meso' indicates that the structure of the electric contact portion in between a classic microstructure that can be detected only by using a microscope and a classic macrostructure whose components are visible to the naked eye. In the present case, the mesostructured electric contact portion is a superstructure comprising two sub-structures. The first sub-structure is formed by the plurality of slots. Since the slots have an average slot width in a range of about 50 micrometers to about 0.5 millimeters they can form a microstructure themselves in case that the slot width is at the lower end of the range. The second sub-structure is formed by the microstructure comprising the current conducting portion, for example silver with metal oxide particles in the size of about 50 micrometers. Therefore, the mesostructured electric contact portion is a specifically designed mixture of substantially ideal current paths and substantially electrically insulating portions that are arranged to a cluster such that the interruption current is directed and guided in a preselected and preferred, i.e. a predesigned direction within the mesostructured electric contact portion and its proximate areas. As will be explained later, the slots do not necessarily remain empty.

The plurality of current paths is inclined to the first contact surface and the second contact surface, respectively—i.e. if the second contact has a mesostructured electric contact portion, too—at a first angle measuring less than 60 degrees such that an interruption current flowing through the mesostructured electric contact portion and through an electric arc extending in between the first contact surface and the second contact surface, respectively—i.e. if the second contact has a mesostructured electric contact portion, too—after lifting the first contact surface off the second contact surface pushes said electric arc in the direction of the apex of said first angle from a first to a second position.

If the magnetic pressure on the electric arc shall be even more intense, it is recommended to select the first angle to be less than 45 degrees.

In a particularly production-friendly embodiment the plurality of current paths extends parallel to one another in the at least one of a first electric contact and the second electric contact. In other words, the plurality of slots is created in a pattern, e.g. by way of laser-cutting the slots into the first contact surface and the second electric contact, where applicable. The pattern does not need to be uniform as it may prove advantageous to deviate from that pattern in edge portions, for example.

Owing to the production-friendliness, it proved advantageous, if the plurality of slots has a strip-shaped cross section extending in the switching plane each, wherein a major axis of that strip-shaped cross section each extends in a direction of the current paths. Please note that the term 'strip-shaped' shall not be understood to be limited to rectangular shapes only. In the contrary, variations of the generally elongated openings shall encompass oblong or elliptical shapes in that cross-section, too. Moreover, non-linear cross-sections like arcuate slots are achievable, for example in embodiments where the slots are manufactured by way of laser cutting.

For achieving a particularly advantageous effect in the mesostructured electric contact portion, an average slot width extending in the switching plane along a minor axis of the cross-section and running perpendicularly to the major axis is in a range of 50 micrometers to 0.5 millimeters.

In embodiments, where a substantial guidance of the interruption current through the current paths via the ridges is required, an aspect ratio of a slot length extending in the direction of the major axis to a slot width extending in the direction of the minor axis is at least 4:1.

Depending on the embodiment, the plurality of slots can be evenly distributed or not evenly distributed along the at least one of the first contact surface and the second contact surface when seen in the switching plane.

Owing to the ampacity in view of the overall compactness of the electrical contact system, good results are achievable if an overall slot-to-ridge ratio along at least one of the first contact surface and the second contact surface, respectively—i.e. if the second contact has a mesostructured electric contact portion, too—in the switching plane is in a range of 30% to 70% up to 50% to 50%. The latter value holds particularly true if the slots are not filled by a filler as addressed later on in this disclosure.

Care must be taken that the foot point of the electric arc is not formed at the end face of a single ridge or a single current path to prevent an undesired destruction of the mesostructured by excessive local melting. Therefore, it is advisable that a minimal spacing of two neighboring slots in the direction of the first contact surface in the switching plane is at least one third of a calculated arc impact area diameter. The arc impact area diameter extends in the first contact surface and delimits a region of the first contact where the electric arc melts the first contact surface in an operating state of the electrical contact system.

In embodiments, where an open and thus rough contact surface is undesired, it is nonetheless possible to profit from the enhanced magnetic force acting on the electric arc, if the plurality of slots extending in the switching plane such that their proximal ends pointing towards the at least one of the first contact surface and the second contact surface, respectively—i.e. if the second contact has a mesostructured electric contact portion, too—are located at a predefined distance under the first contact surface and the second contact surface, respectively, such that an arcing contact layer is formed. The predefined distance varies in accordance to the current density at the arc impact area as well as the contact material selected for the first and/or second contact surface.

Good switching results are achievable if the arcing contact layer has a thickness of about 50 micrometers to 2 millimeters. The arcing contact layer is made of a suitable arcing contact material and can be formed by a separate element or integrated into a contact carrier or an intermediate conductor body, depending on the requirements and general set-up of the circuit breaker. In an exemplary embodiment designed for a low voltage application, the arcing contact layer has a thickness of about 0.5 mm.

As it may not be suitable to convert all existing electric contacts with a mesostructured electric contact portion, the desirable effect is nonetheless achievable if at least one of the first electric contact and the second electric contact comprises a contact piece that is mechanically and electrically connected to a contact carrier. Said contact piece is designed to act as arcing contact layer. The mesostructured electric contact portion is provided in one of a) the contact piece concerned, b) the contact carrier concerned, c) the contact piece as well as in the contact carrier concerned, wherein the contact piece and the contact carrier are arranged relative to one another such that the current paths of the contact piece continue in the current paths of the carrier. It goes without saying that the positive effect will remain even if the first angle in the contact piece and the first angle in the contact carrier differ somewhat to one another, provided that the general direction of the current paths remains untouched.

For achieving an optimal magnetic pressure on the electric arc it is advisable that not only the first electric contact but also the second electric contact have a mesostructured electric contact portion each. The slots of the mesostructured electric contact portion in the second electric contact are oriented such that an angle leg of first angle intersects with an angle leg of first angle of the mesostructured electric contact portion in the second electric contact in an area of the switching plane located between the first contact surface and the second contact surface. In an exemplary embodiment where the first angle first measures 45° each, there will be an intersection angle of 90°.

A mechanically simple and yet effective way to urge the interruption current through the current paths of the mesostructured electric contact portion resides in arranging a notch arranged proximate to said mesostructured electric contact portion of the electric contact concerned. That notch is designed and arranged such that the interruption current is guided towards the current paths and may have a shape or cross-section meeting also filed control requirements.

The formation of current paths does not necessarily require that the slots are hollow. In the contrary, at least some slots of the plurality of slots can be filled with a filler material having electrical low conducting or electrical insulating properties. An advantage of having such a filler resides in that it contributes to the overall mechanical stability of the mesostructured electric contact portion and thus the whole electrical contact system as it prevents the ridges form getting molten or fused to one another by the energy of the electric arc such that the desirable effect is lowered or even unavailable any longer in a long term operation of the switchgear. Ensuring a satisfactory mesostructured electric contact portion and thus electrical contact system becomes particularly important if the ridges are distanced comparatively wide from one another. The filler material comprises at least one element of the group comprising a) polymer material, b) tungsten material, c) a material that releases a carbonaceous gas when exposed to the electric arc, d) a metal oxide.

An advantage of a) resides in that it is fairly easy to realize as the slots may be filled by way of impregnation. Examples of suitable polymers are Polyoxymethylene (POM), Polyamide (PA), Polypropylene (PP), Polycarbonate (PC). An advantage of b) resides in that it contributes to better protection against excessive wear of the electrical contact system. In case of c) the material can contribute actively to a desirable quick arc extinction. An advantage of d) resides in that it allows for an inexpensive formation of electrically insulating portions alongside the current paths. Examples of suitable polymers are Polyoxymethylene (POM), Polyamide (PA), Polypropylene (PP), Polycarbonate (PC). In an exemplary embodiment. Aluminum oxide is used as filler. In other exemplary examples, the filler comprises Silicon oxide, Titanium oxide, Zinc oxide, Tin. The reader will recognize that it possible to combine at least two of elements a) to d) for profiting from both advantageous effects.

The above-mentioned positive effects will contribute to an improved low or medium voltage switchgear if it comprises such an electrical contact system.

BRIEF DESCRIPTION OF THE DRAWINGS

The description makes reference to the annexed drawings, which are schematically showing in FIG. 1 a side view of a conventional electrical contact system.

In the drawings identical or at least functionally identical elements and currents are given identical reference characters.

WAYS OF WORKING THE INVENTION

Figure 1:
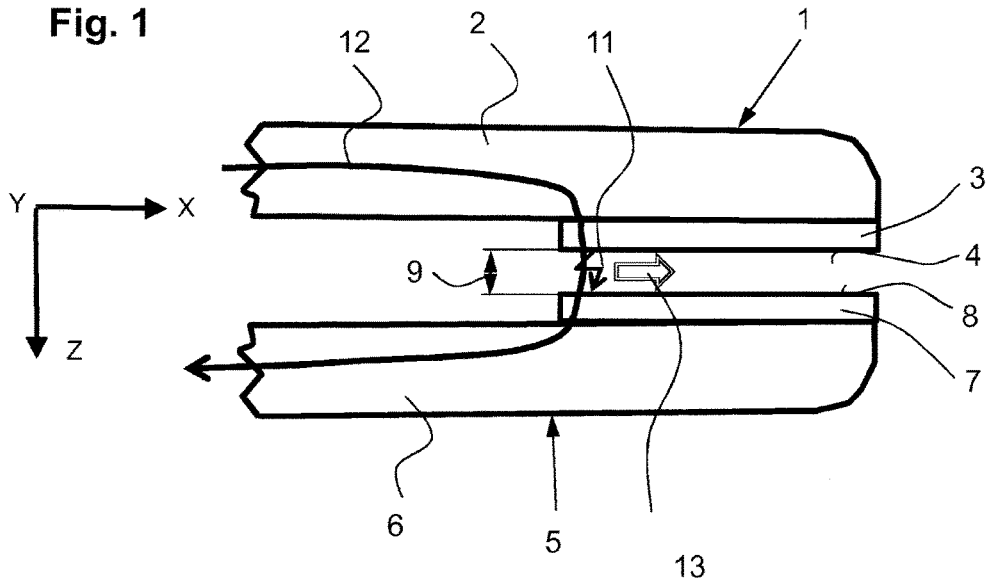
Figure 2:
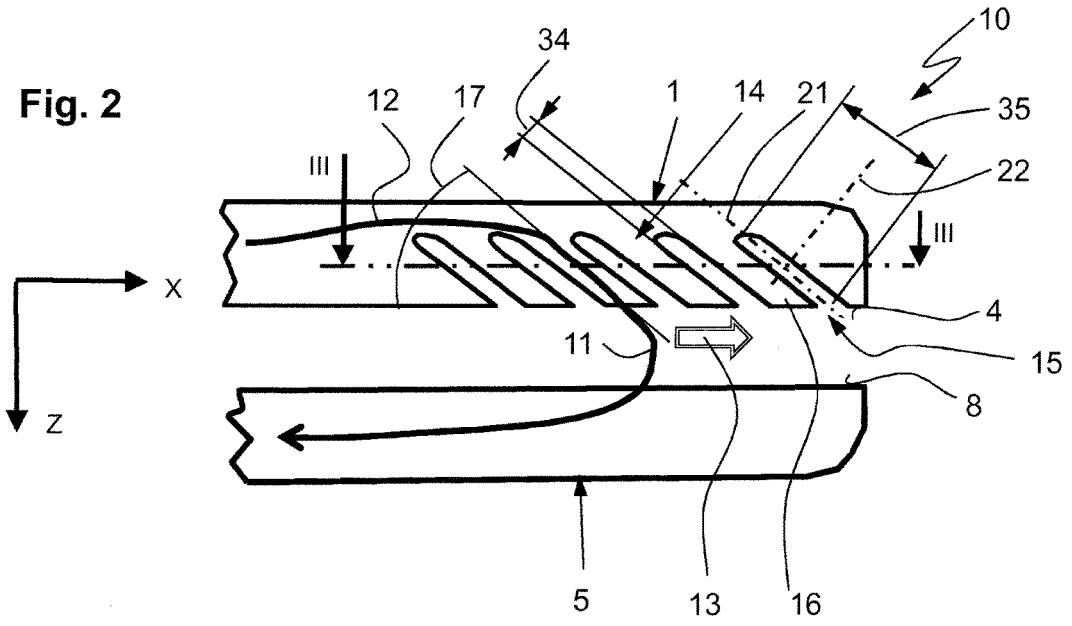
FIG. 2 a side view of a first embodiment of an electrical contact system according to the present invention.

A side view of a side view of a first embodiment of an electrical contact system 10 according to the present invention is shown in FIG. 2. In fact the side view is a cross-section of the electrical contact system whereas any cross-hatching has been omitted for the sake of better visibility and enhanced clarity. That electrical contact system 10 comprises a first electric contact 1 shown as an upper contact as well as a second electric contact 3 shown as a lower contact in an open state of the electrical contact system. The first electric contact and the second electric contact are made form a copper alloy. In contrast to the electrical contact system of FIG. 1, there is no contact piece such that the first contact surface 4 is provided directly at the end region of the first electric contact 1. The second contact surface 8 is provided directly at the end region of the second electric contact 5. The first electric contact 1 and of the second electric contact 5 are movable relative to one another along a switching path extending in a switching plane X-Z. The switching path can be linear or arcuate.

The first contact surface 4 and the second contact surface 8 touch each other in a closed state of the electrical contact system. The first contact surface 4 is displaced by an insulating distance 9 to the second contact surface 8 in an open state of the electrical contact system such that the desired interruption and safe electric insulation between the first and second contact is achieved. The first contact surface 4 and the second contact surface 8 extend transversely, i.e. perpendicularly to said switching plane X-Z in the direction of virtual plane X-Z. Once this electrical contact system is opened, an electric arc 11 evolves between the first contact surface 4 and the second contact surface 8. Since the current path of the nominal as well as of the interruption current path 12 lead through the first electric contact 1 and the second electric contact 5 in a loop when seen in plane X-Z, the natural magnetic field of the interruption current 12 pushes the electric arc 11 from the left to the right.

The first electric contact 1 comprises a mesostructured electric contact portion 14 with a plurality of slots 15 and ridges 16 formed between neighboring slots of the plurality of slots 15. The plurality of slots 15 and ridges 16 extend in a direction running transversely/perpendicularly to the switching plane X-Z and form a plurality of current paths 12 leading through the ridges 16 of the mesostructured electric contact portion 14. The current paths 16 are inclined to the first contact surface at a first angle 17 measuring less than 60 degrees such that an interruption current flowing through the mesostructured electric contact portion 14 and through an electric arc 11 extending in between the first contact surface 4 and the second contact surface 8 after lifting the first contact surface 4 off the second contact surface 8 pushes said electric arc 11 in the direction of the apex of said first angle 17 from a first position 18 (here located at the left) to a second position (here located at the tip end of the first electric contact 1).

The inclined current paths 16 (of which only a single current path of the plurality of current paths is shown in FIG. 2 for the sake of clarity) guide and direct the interruption current 12 such that compared to the conventional set up shown in FIG. 1 the current is prevented or at least substantively hampered from leaving the first contact surface 4 in a perpendicular direction relative to the first contact surface 4. As a result, the force 13 acting on the electric arc 11 is bigger in the embodiment according to FIG. 2 than in the embodiment according to FIG. 1. Some quantification of the force difference has been made in that the arrow of force 13 is illustrated bigger than in FIG. 1.

The slots 15 have been cut into the first electric contact 1 by way of laser-cutting at a first angle of about 45° such that the plurality of current paths extends parallel to one another. The slots have a strip-shaped cross section extending in the switching plane X-Z each, wherein a major axis 21 of that strip-shaped cross section each extends in a direction of the current paths 16, i.e. the ridges 16. The average slot width 34 extending in the switching plane along a minor axis 22 of the cross-section and running perpendicularly to the major axis 21 is about 0.3 millimeters for use in a low voltage switchgear.

An aspect ratio of a slot length 35 extending in the direction of the major axis 21 to a slot width 34 extending in the direction of the minor axis 22 is about 5:1. An overall slot-to-ridge ratio along at least one of the first contact surface 4 (say along line III-III in FIG. 2 in the slotted area only) is about 40% to 60%.

Figure 7:
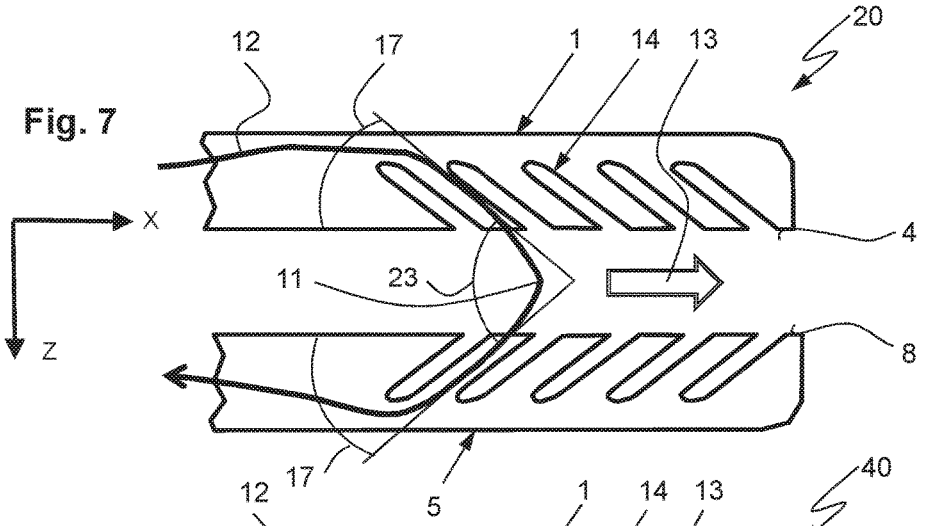
FIG. 7 a side view of the second embodiment of FIG. 3.

Next, a side view of a second embodiment of an electrical contact system 20 according to the present invention is described with reference to FIG. 3 and FIG. 4 and FIG. 7. Hereinafter, only differences in effect and elements compared to the first embodiment 10 shall be addressed.

In this embodiment 20, the second electric contact 5 is shaped exactly the same way as the first electric contact 1. Hence, the slots 15 of the mesostructured electric contact portion 14 in the second electric contact 5 are oriented such that an angle leg of first angle 17 intersects with an angle leg of first angle 17 of the mesostructured electric contact portion 14 in the second electric contact 5 in an area of the switching plane X-Z located between the first contact surface 4 and the second contact surface 8 at an intersection angle 23 of about 90°.

Figure 3:
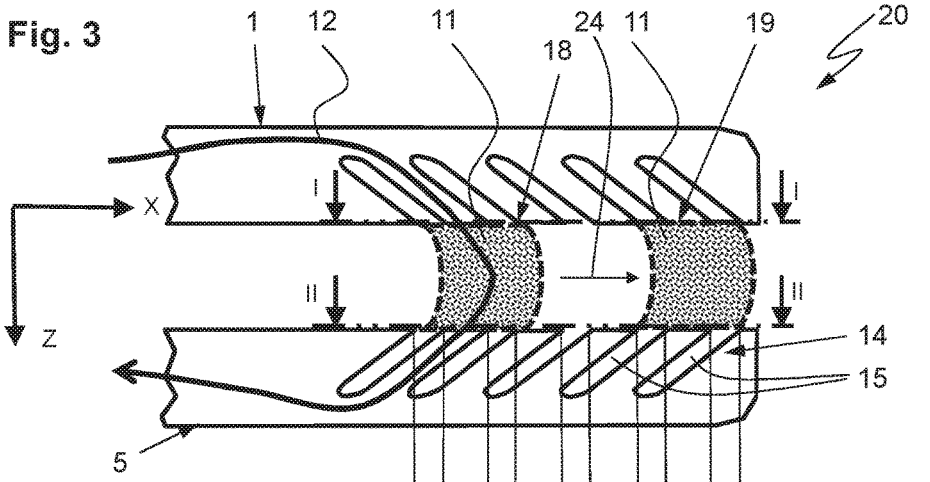
FIG. 3 a side view of a second embodiment of an electrical contact system according to the present invention.

In FIG. 3, the electric arc 11 is shown more realistic than in FIG. 1 as an arc column (indicated in a dotted pattern) extending between the first contact surface 3 and the second contact surface 8. The column to the left represents the first position 18 of the electric arc 11 after ignition whereas the column to the right represents the second position 19 of the electric arc 11 shortly before extinction. Note, that although the electric arc 11 is shown both in the first position 18 and in the second position 19 in FIG. 3, it will not be at both positions at the same moment in time in real life of the switchgear. The arc travel direction is indicated by arrow 24. Again, the interruption current 12 is indicated only in a representative location for displaying its new shape compared to FIG. 2 embodiment 10.

Figure 4:
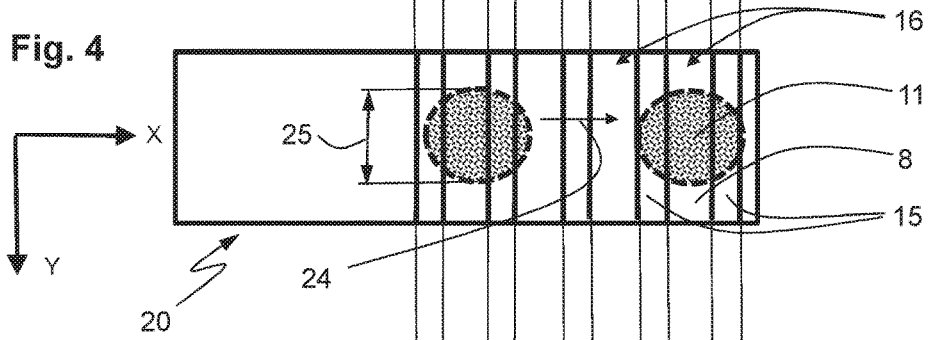
FIG. 4 a top view on the lower electric contact along plane II-II of FIG. 3.

FIG. 4 reveals that a minimal spacing of two neighboring slots 15 in the direction of the first contact surface 4 and the second contact surface 8 in the switching plane X-Z is at least one third of a calculated arc impact area diameter 25 such that the arc 11 can start always from at least two ridges 16.

As shown in figure, the desired force 13 on the electric arc is bigger than in the first embodiment 10.

Figure 5:
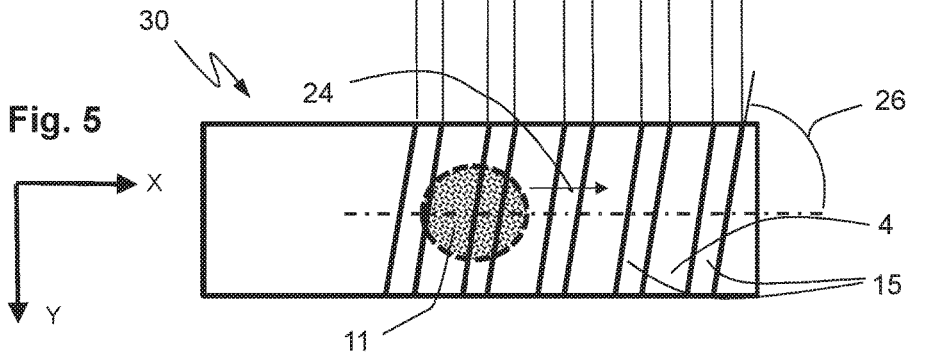
FIG. 5 a top view on the lower electric contact of a third embodiment along plane II-II of FIG. 3.
Figure 6:
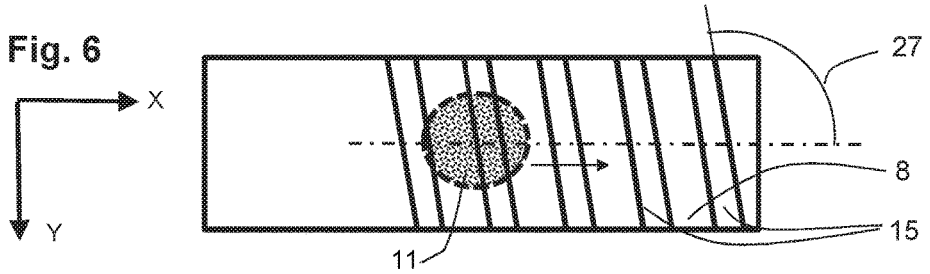
FIG. 6 a bottom view on the upper electric contact of the third embodiment shown in combination with FIG. 5.

A third embodiment 30 to the embodiment 20 shown in FIG. 3 is shown and explained with respect of FIG. 5 and FIG. 6. The only modification relies in that the slots 15 are not only inclined about the first angle 17 but also about a second angle 26 in case of the lower electric contact seen along plane II-II as shown in of FIG. 3. Likewise, the slots 15 are not only inclined about the first angle 17 but also about a third angle 26 in case of the upper electric contact seen along plane I-I as shown in of FIG. 3. The provision of the second angle 26 and the third angle 27 are advantageous as their contribute to a smoother continuous, i.e. a less staggered travel of the electric arc 11 in the arc travel direction 24 compared to the second embodiment 20.

Figure 8:
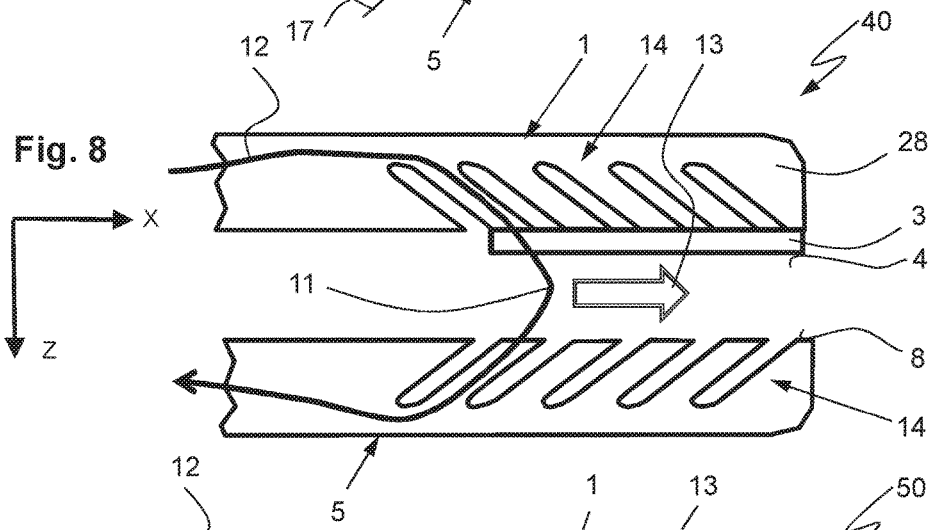
FIG. 8 a side view of a fourth embodiment of an electrical contact system according to the present invention.

A fourth embodiment 40 of the electrical contact system is shown and explained with respect of FIG. 8. The only modification compared to the third embodiment resides in that relies in that the first electric contact 1 comprises a first contact piece 3 that is mechanically and electrically connected to a contact carrier 28 of the first electric contact 1. The contact carrier 28 has essentially the same function as the first contact carrier 2 and the second contact carrier 6. Said contact piece 3 comprises the first contact surface 4 and is thus designed to act as arcing contact layer for the electric arc 11. The arcing contact layer formed by said contact piece 3 has a thickness of about 0.5 mm for use in a low voltage switchgear.

Figure 9:
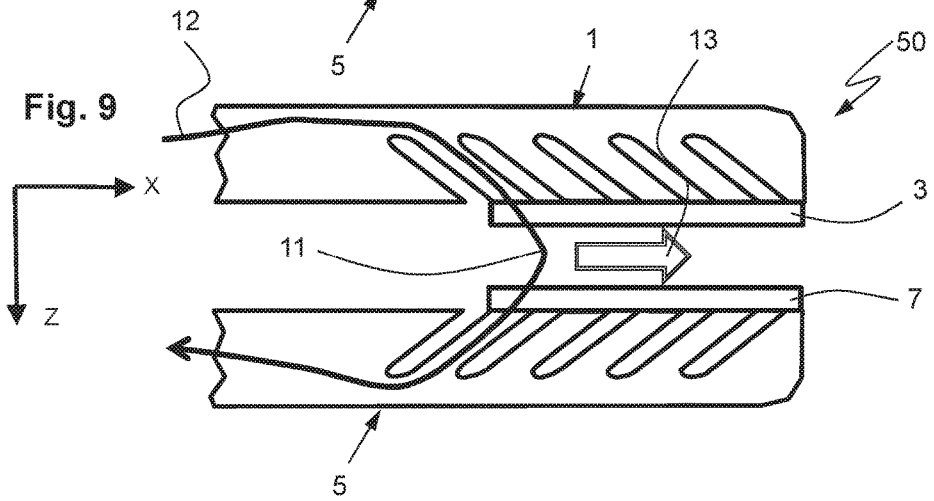
FIG. 9 a side view of a fifth embodiment of an electrical contact system according to the present invention.

The fifth embodiment 50 of the electrical contact system shown and explained with respect of FIG. 9 differs to the fourth embodiment 40 in that a second contact piece 7 that is mechanically and electrically connected to a contact carrier 28 of the second electric contact 5 the same way as in the first electric contact 1.

Figure 10:
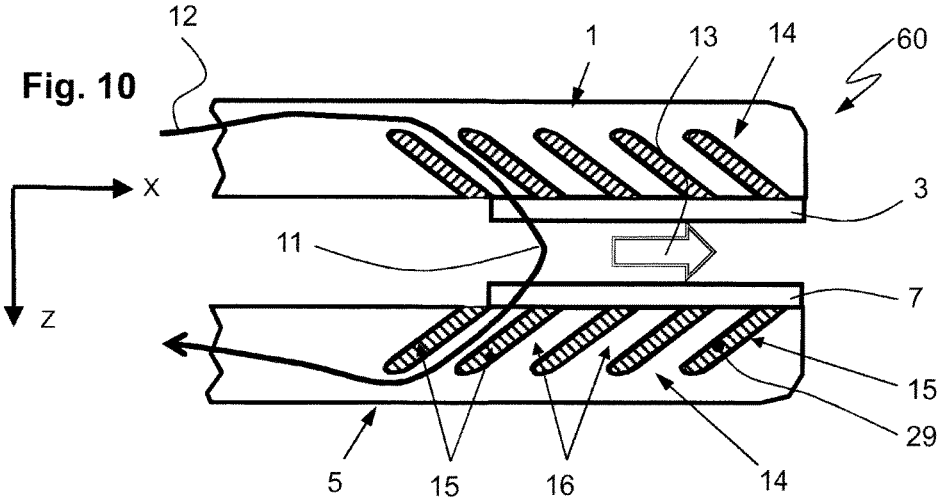
FIG. 10 a side view of a sixth embodiment of an electrical contact system according to the present invention.

The sixth embodiment 60 of the electrical contact system shown and explained with respect of FIG. 10 differs to the fifth embodiment 50 in that all slots 15 are filled with a filler material 29 comprising Aluminum oxide for enhancing the overall mechanical stability and durability of the mesostructured electrical contact portion 14.

Figure 11:
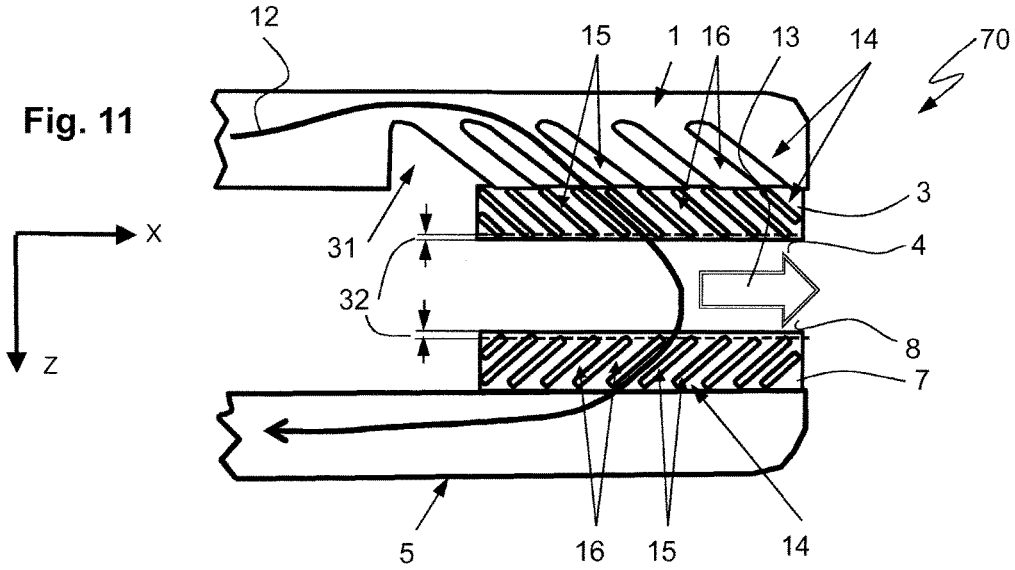
FIG. 11 a side view of a seventh embodiment of an electrical contact system according to the present invention.

The seventh embodiment shown and explained with respect to FIG. 11 has a first electric contact 1 that is formed differently than the second electric contact 5. Compared to the fifth embodiment 50 the first electric contact 1 comprises a notch 31 arranged proximate to the mesostructured electric contact portion 14. Said notch 31 is designed and arranged such that the interruption current 12 is guided towards the current paths extending in between the ridges 16. Moreover, the first contact piece 3 is formed such that is has a mesostructured electric contact portion 14 as well. The first angle of both about 45° but the slots 15 and ridges 16 in the first contact piece 3 are thinner than in the contact carrier 28. In addition extend the slots 15 in the first contact piece 3 not to the first contact surface 4. In the contrary, the plurality of these slots 15 extend in the switching plane X-Z only such that their proximal ends pointing towards the first contact surface 4 are located at a distance 32 under the first contact surface 4 and such that an arcing contact layer 33 (shown in dotted lines in FIG. 11) is formed. In FIG. 11, the arcing layer has a thickness that is comparatively small in the Z-direction, i.e. about 0.4 mm.

Compared to the first embodiment 10 shown in FIG. 1 and the fifth embodiment 50 shown in FIG. 9, the second contact piece 7 shown as lower contact of the seventh embodiment 70 has a second contact piece 7 that is mechanically and electrically connected to its contact carrier 28. The second contact piece 7 has the very same geometry as the first contact piece 3 but is mounted in a mirrored fashion compared to the first contact piece 3 such that the first angles of the first electric contact 1 and of the second electric contact 5 intersect at an intersection angle as described earlier on.

The seventh embodiment 70 is purely schematically and shows a possible variation to profit from the present invention. Where required, further embodiments of the electrical contact system can comprise a second electric contact that is formed the same way as the first electric contact above. Likewise it is possible to form the first contact the same way as the second electric contact above.

The skilled reader will recognize that a plurality of combinations of any first electric contacts and second electric contacts disclosed in this description and the figures is achievable such that one will arrive at the desired effect of the magnetic pressure on the electric arc.

LIST OF REFERENCE NUMERALS

1 first electric contact
2 first contact carrier
3 first contact piece
4 first contact surface
5 second electric contact
6 second contact carrier
7 second contact piece
8 second contact surface
9 insulating distance; isolating distance; insulating gap
10, 20, 30, 40, 50, 60, 70 electrical contact system
11 electric arc
12 interruption current; —
13 pressure/force acting on the electric arc
14 mesostructured electric contact portion
15 slot
16 ridge; current path
17 first angle
18 first position of the arc
19 second position of the arc
21 major axis
22 minor axis
23 intersection angle
24 arc travel direction
25 arc impact area diameter
26 second angle
27 third angle
28 contact carrier
29 filler material
31 notch
32 distance
33 arcing contact layer
34 slot width
35 slot length

The invention claimed is:

1. An electrical contact system comprising a first electric contact with a first contact surface, a second electric contact with a second contact surface, and a set of splitter plates, wherein the first electric contact and the second electric contact are movable relative to one another along a switching path extending in a switching plane (X-Z) such that the first contact surface and the second contact surface touch each other in a closed state of the electrical contact system, and wherein the first contact surface is displaced by an insulating distance to the second contact surface in an open state of the electrical contact system, and wherein the first contact surface and the second contact surface extend transversely to said switching plane (X-Z), wherein at least one of the first electric contact and the second electric contact comprises a structured electric contact portion with a plurality of slots and ridges formed between neighboring slots of the plurality of slots, wherein the plurality of slots and ridges extend in a direction running transversely to said switching plane (X-Z) form a plurality of current paths leading through the structured electric contact portion, and wherein the plurality of current paths is inclined to the first contact surface and the second contact surface, respectively, at a first angle measuring less than 60 degrees such that an interruption current flowing through the structured electric contact portion and through an electric arc extending in between the first contact surface and the second contact surface, respectively, after lifting the first contact surface off the second contact surface pushes said electric arc in the direction of the splitter plates and off the first and second electric contacts.

2. The electrical contact system according to claim 1, wherein the first angle is less than 45 degrees.

3. The electrical contact system according to claim 1, wherein the plurality of current paths extends parallel to one another in the at least one of a first electric contact and the second electric contact.

4. The electrical contact system according to claim 1, wherein the plurality of slots has a strip-shaped cross section extending in the switching plane (X-Z) each, wherein a major axis of that strip-shaped cross section each extends in a direction of the current paths, an average slot width extending in the switching plane along a minor axis of the cross-section and running perpendicularly to the major axis is in a range of 50 micrometers to 0.5 millimeters.

5. The electrical contact system according to claim 4, wherein an aspect ratio of a slot length extending in the direction of the major axis to a slot width extending in the direction of the minor axis is at least 4:1.

6. The electrical contact system according to claim 1, wherein an overall slot-to-ridge ratio along at least one of the first contact surface and the second contact surface, respectively, in the switching plane (X-Z) is in a range of 30% to 70%.

7. The electrical contact system according to claim 1, wherein a minimal spacing of two neighboring slots in the direction of the first contact surface in the switching plane (X-Z) is at least one third of a calculated arc impact area diameter, wherein the arc impact area diameter extends in the first contact surface and delimits a region of the first contact where the electric arc melts the first contact surface in an operating state of the electric contact system.

8. The electrical contact system according to claim 1, wherein the plurality of slots extending in the switching plane (X-Z) such that their proximal ends pointing towards the at least one of the first contact surface and the second contact surface, respectively, are located at a distance under the first contact surface and the second contact surface, respectively, such that an arcing contact layer is formed.

9. The electrical contact system according to claim 8, wherein the arcing contact layer has a thickness of about 50 micrometers to 2 millimeters.

10. The electrical contact system according to claim 1, wherein at least one of the first electric contact and the second electric contact comprises a contact piece that is mechanically and electrically connected to a contact carrier, wherein said contact piece is designed to act as arcing contact layer, and wherein the structured electric contact portion is provided in one of a) the contact piece of the at least one of the first electric contact and the second electric contact, b) the contact carrier connected to the at least one of the first electric contact and the second electric contact, c) both of a) and b), wherein the contact piece and the contact carrier are arranged relative to one another such that the current paths of the contact piece continue in the current paths of the carrier.

11. The electrical contact system according to claim 1, wherein the first electric contact as well as the second electric contact have a structured electric contact portion each, wherein the slots of the structured electric contact portion in the second electric contact are oriented such that an angle leg of first angle intersects with an angle leg of first angle of the structured electric contact portion in the second electric contact in an area of the switching plane (X-Z) located between the first contact surface and the second contact surface.

12. The electrical contact system according to claim 1, wherein at least one of the first electric contact and the second electric contact comprises a notch arranged proximate to the structured electric contact portion, wherein said notch is designed and arranged such that the interruption current is guided towards the current paths.

13. The electrical contact system according to claim 1, wherein at least some slots of the plurality of slots are filled with a filler material having electrical conducting or electrical insulating properties being lower than the electrical conducting of the ridges.

14. The electrical contact system according to claim 13, wherein the filler material comprises at least one element of the group comprising a) polymer material, b) tungsten material, c) a material that releases a carbonaceous gas when exposed to the electric arc, d) metal oxide.

15. A low or medium voltage switchgear, comprising an electrical contact system according to claim 1.

16. The electrical contact system according to claim 2, wherein a minimal spacing of two neighboring slots in the direction of the first contact surface in the switching plane (X-Z) is at least one third of a calculated arc impact area diameter, wherein the arc impact area diameter extends in the first contact surface and delimits a region of the first contact where the electric arc melts the first contact surface in an operating state of the electric contact system.

17. The electrical contact system according to claim 2, wherein the plurality of current paths extends parallel to one another in the at least one of a first electric contact and the second electric contact.

18. The electrical contact system according to claim 2, wherein the plurality of slots has a strip-shaped cross section extending in the switching plane (X-Z) each, wherein a major axis of that strip-shaped cross section each extends in a direction of the current paths, an average slot width extending in the switching plane along a minor axis of the cross-section and running perpendicularly to the major axis is in a range of 50 micrometers to 0.5 millimeters.

19. The electrical contact system according to claim 18, wherein an aspect ratio of a slot length extending in the direction of the major axis to a slot width extending in the direction of the minor axis is at least 4:1.

20. The electrical contact system according to claim 2, wherein the plurality of slots extending in the switching plane (X-Z) such that their proximal ends pointing towards the at least one of the first contact surface and the second contact surface, respectively, are located at a distance under the first contact surface and the second contact surface, respectively, such that an arcing contact layer is formed.

21. The electrical contact system according to claim 1, wherein the structured electric contact portion is a porous compound material.

22. The electrical contact system according to claim 1, wherein the ridges of the structured electric contact portion have dimensions between 50 micrometers and 2 millimeters.

23. An air-insulated switchgear comprising the electrical contact system according to claim 1.

* * * * *